US006830498B2

(12) United States Patent
Elling

(10) Patent No.: US 6,830,498 B2
(45) Date of Patent: Dec. 14, 2004

(54) TOY GAME

(75) Inventor: Jesper Elling, Struer (DK)

(73) Assignee: Interlego AG, Baar (CH)

( * ) Notice: Subject to any disclaimer, the term of this patent is extended or adjusted under 35 U.S.C. 154(b) by 69 days.

(21) Appl. No.: 10/168,874

(22) PCT Filed: Dec. 21, 2000

(86) PCT No.: PCT/DK00/00722

§ 371 (c)(1),
(2), (4) Date: Jun. 21, 2002

(87) PCT Pub. No.: WO01/45815

PCT Pub. Date: Jun. 28, 2001

(65) Prior Publication Data

US 2004/0077283 A1 Apr. 22, 2004

(30) Foreign Application Priority Data

Dec. 22, 1999 (DK) ..... 1999 01839

(51) Int. Cl.[7] ..... A63H 30/00; A63H 17/00; A63H 18/00

(52) U.S. Cl. ..... 446/454; 446/6; 446/435; 446/444

(58) Field of Search ..... 446/6, 435, 442, 446/443, 444, 445, 446, 454

(56) References Cited

U.S. PATENT DOCUMENTS

| | | | | |
|---|---|---|---|---|
| 2,683,956 A | * | 7/1954 | Conte | 446/442 |
| 3,218,757 A | | 11/1965 | Benkoe | |
| 3,442,047 A | | 5/1969 | Quigley et al. | |
| 3,597,876 A | * | 8/1971 | Haji | 446/468 |
| 4,521,206 A | | 6/1985 | Saffer et al. | |
| 6,179,686 B1 | * | 1/2001 | Ogawa et al. | 446/429 |
| 6,350,172 B1 | * | 2/2002 | Andrews | 446/440 |

FOREIGN PATENT DOCUMENTS

| | | | | |
|---|---|---|---|---|
| DE | 3203404 A1 | * | 8/1983 | A63H/17/36 |
| GB | 2268417 | | 1/1994 | |

* cited by examiner

*Primary Examiner*—Derris H. Banks
*Assistant Examiner*—Ali Abdelwahed
(74) *Attorney, Agent, or Firm*—Pitney Hardin LLP

(57) ABSTRACT

The invention relates to a toy game comprising a self-propelled vehicle (3) and at least two deflection elements (1, 2) which are adapted to deflect the travelling direction of the vehicle (3) on a base. The invention is characterized in that the elements comprise a curved, concave track for approximately frictionless cooperation with one of the sides of the vehicle and comprise an underside and a grip configured such that a player can reorient and move the element on the base of the vehicle quickly and without obstacles.

15 Claims, 5 Drawing Sheets

Figure 1:
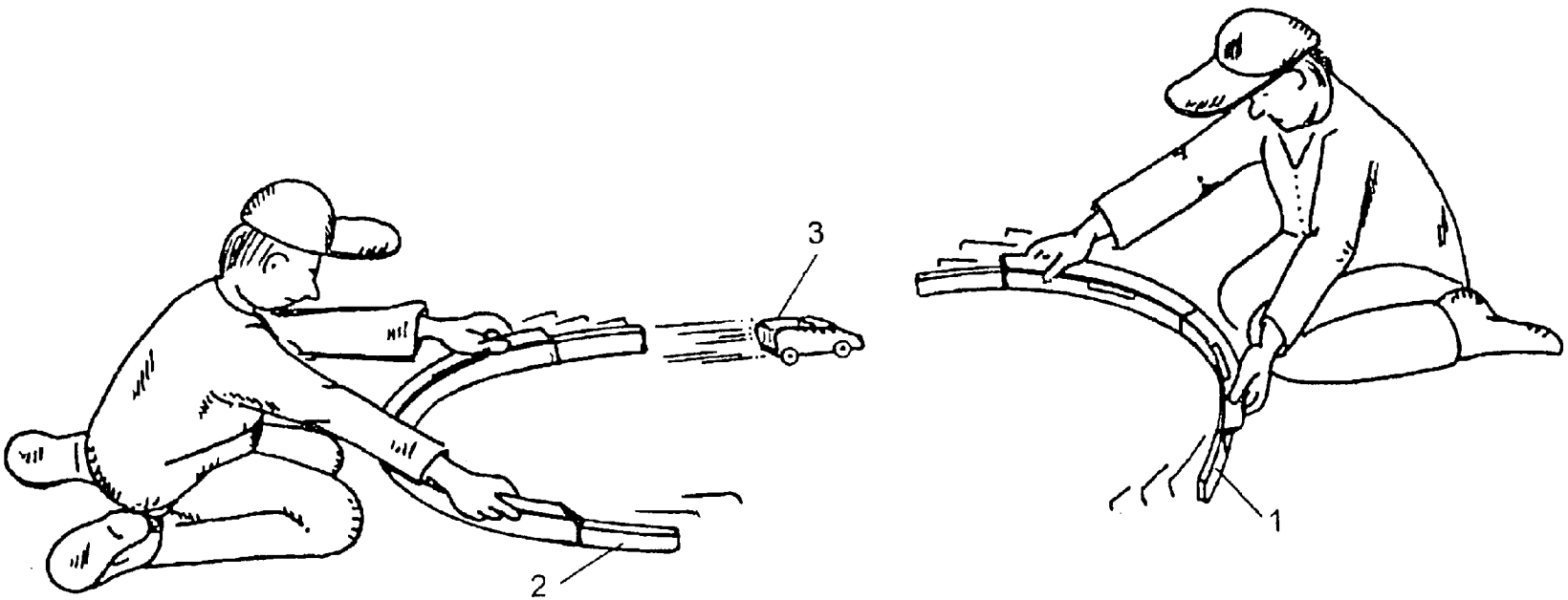

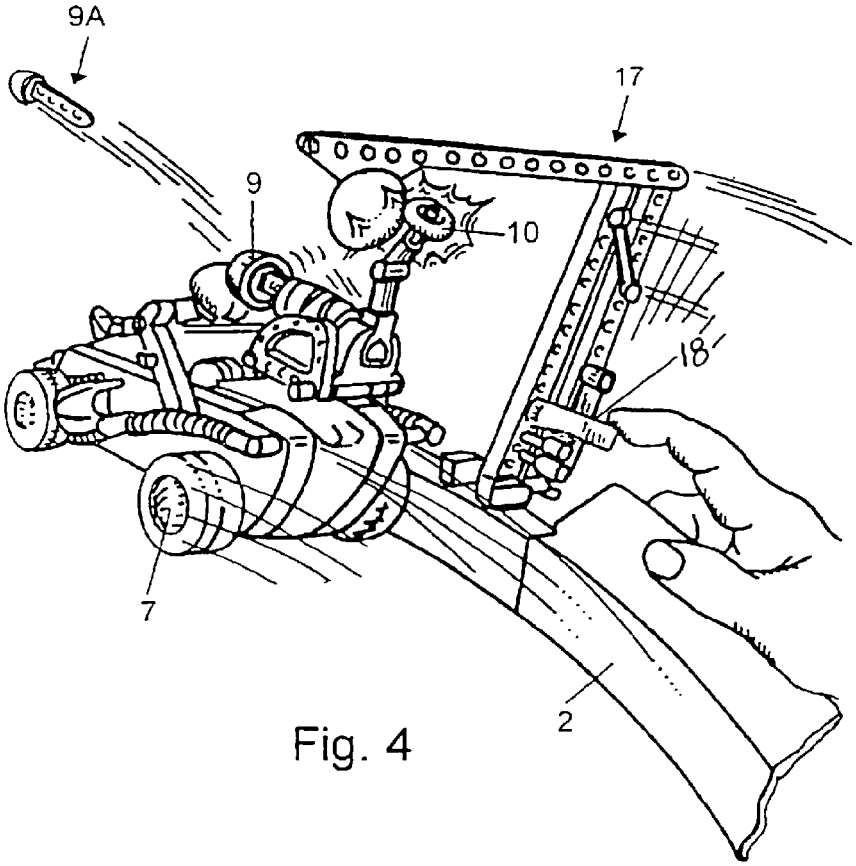
Fig. 4
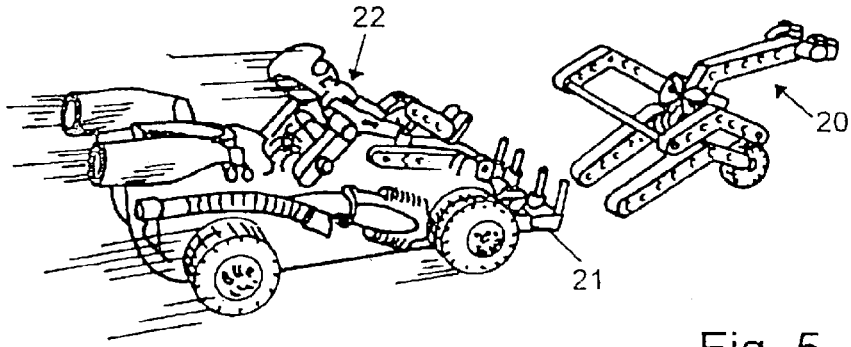
Fig. 5
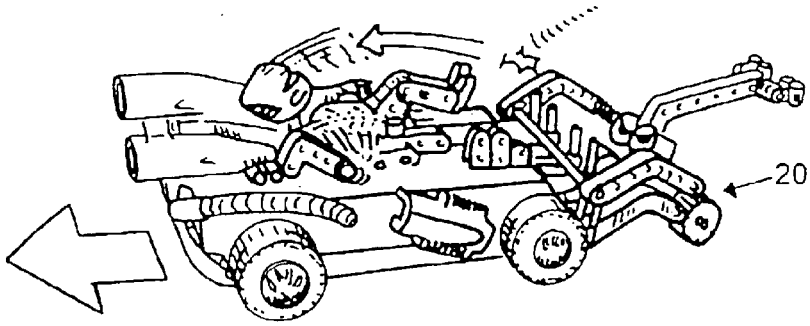

TOY GAME

This application is a 371 of PCT/DK00/00722 filed on Dec. 21, 2000.

Known in the art are toys having deflection elements which are adapted to deflect the traveling direction of a self-propelled vehicle, see e.g., GB A 2 268 417 or U.S. Pat. No. 3,442,047.

The object of the invention is to provide a new toy game.

This object is achieved in that the game comprises deflection elements known per se and a self-propelled vehicle, and in that the deflection elements comprise a curved, concave track for approximately frictionless cooperation with one of the sides of the vehicle, and in that the deflection elements comprise an underside and a grip configured such that a player can reorient and move the deflection elements on the base of the vehicle quickly and without obstacles.

The game will preferably be used by two persons, and when playing the game one player sends the vehicle toward the other player who, by means of his deflection element, catches the vehicle and diverts it in a direction toward the first player. An essential prerequisite for the player's ability to catch and divert the vehicle easily is that the vehicle is caught in the concave, curved track which cooperates with one of the sides of the vehicle. With the above-mentioned known deflection elements, the direction-changing curved track must be received between the wheels of the vehicle, and moreover they are not adapted to be moved and repositioned quickly. The curved track element may also be repositioned during the time when the vehicle cooperates with the curved track. In this connection it is sufficient that the deflection element is curved e.g. 60, even though the direction of travel is to be changed about 180°, because part of the directional change of the vehicle is caused by the deflection element being turned around, whereby the game will also gain more speed.

The sides of the vehicle may advantageously comprise friction-reducing areas for cooperation with the curved track of the deflection element. This may be provided for in that the cooperating parts comprise smooth plastics surfaces, but the vehicle may also be provided with rollers or wheels having vertical axes of rotation.

The versatility of the game may be enhanced additionally in that the vehicle has means which are adapted to change the direction of travel. This may take place either by way of a steering mechanism or by way of a reversing mechanism capable of switching between forward and reverse. When the means are adapted to be mechanically affected, this may take place in connection with the vehicle striking an obstacle. The means may also be activated electronically either via a remote control or via a control program in the vehicle.

Of course, more than two players may participate in the game, which therefore also comprises more than two deflection elements. Likewise, the game may comprise several vehicles, thereby additionally increasing the concentration and excitement of the game.

The game may also comprise a score device which is adapted to count points when it is struck by the vehicle. The score device will typically be arranged at a place halfway between the players.

The game may also comprise obstacles, and the vehicle may be adapted such that the means for changing the traveling direction of the vehicle are affected by the collision with an obstacle.

To provide for additional variations, the deflection elements may comprise means for cooperating with the vehicle for releasing an ejection mechanism, which may e.g. comprise ejection of projectiles.

The deflection elements may be flexible so that their curvature may be changed during the game, but preferably the deflection elements comprise a plurality of sections that may be assembled releasably. The sections may comprise curved members and straight members so that the player himself can design his deflection element.

Figure 3:
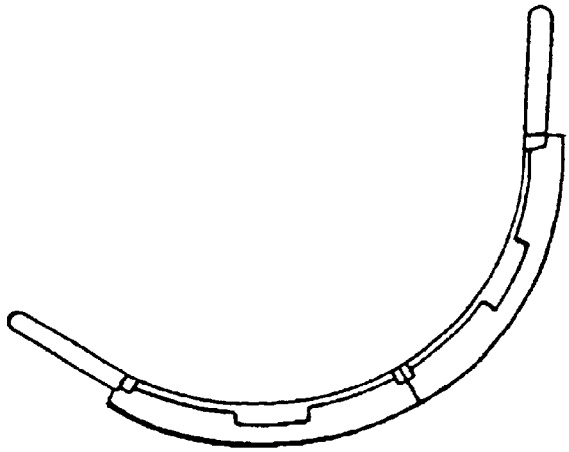
Figure 2:
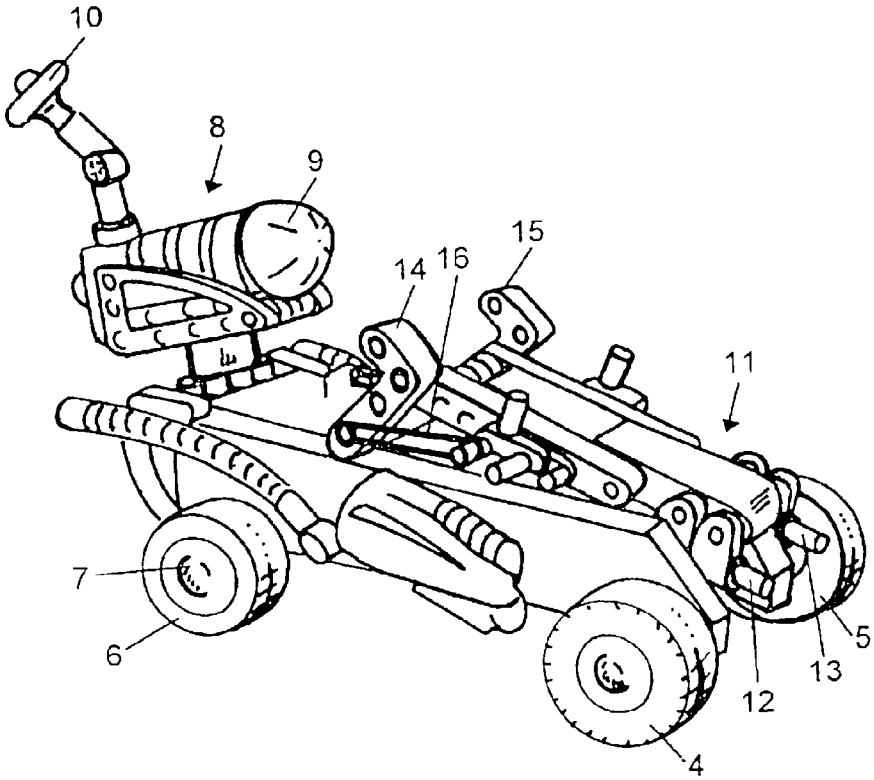
Figure 6:
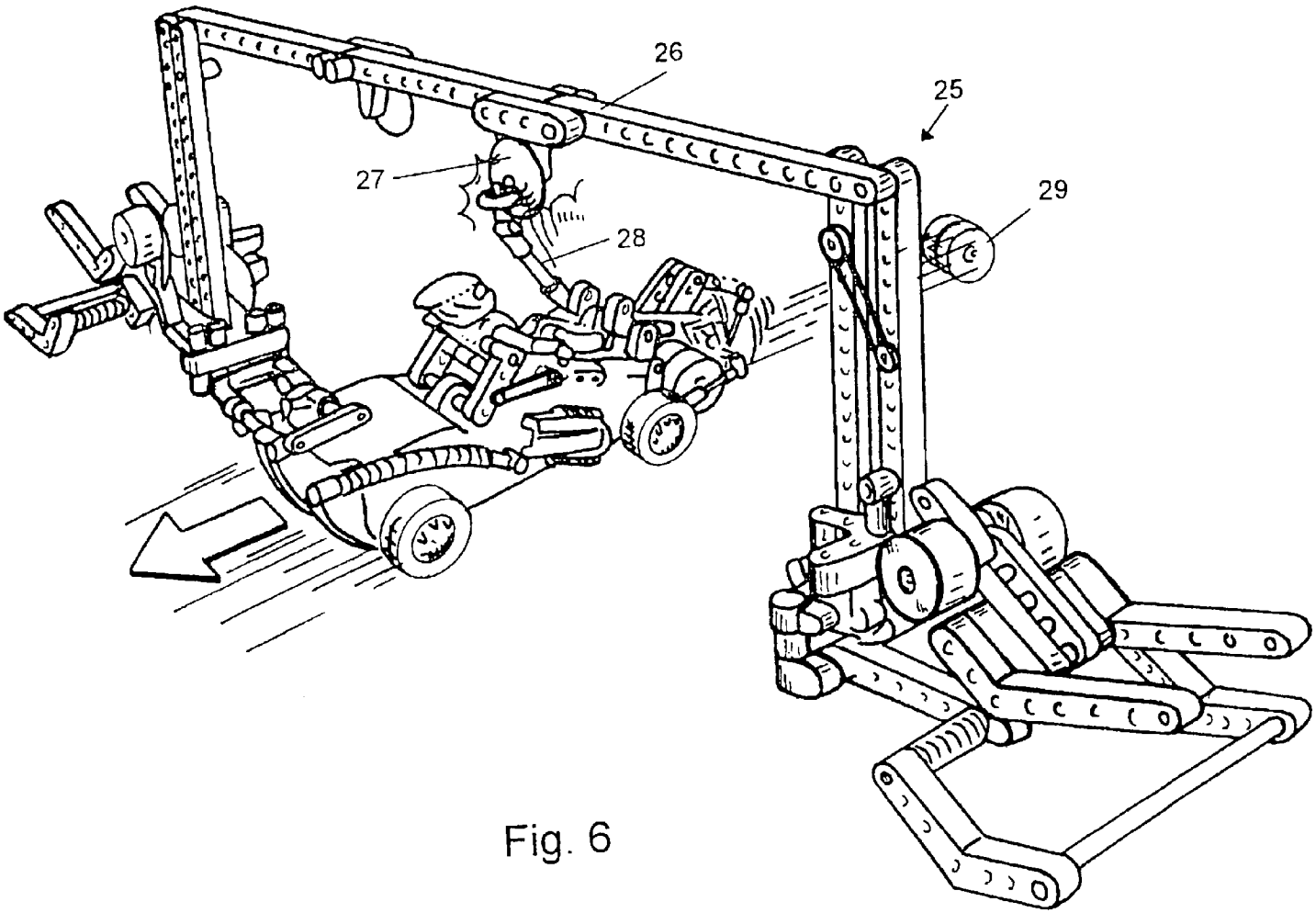
Figure 7:
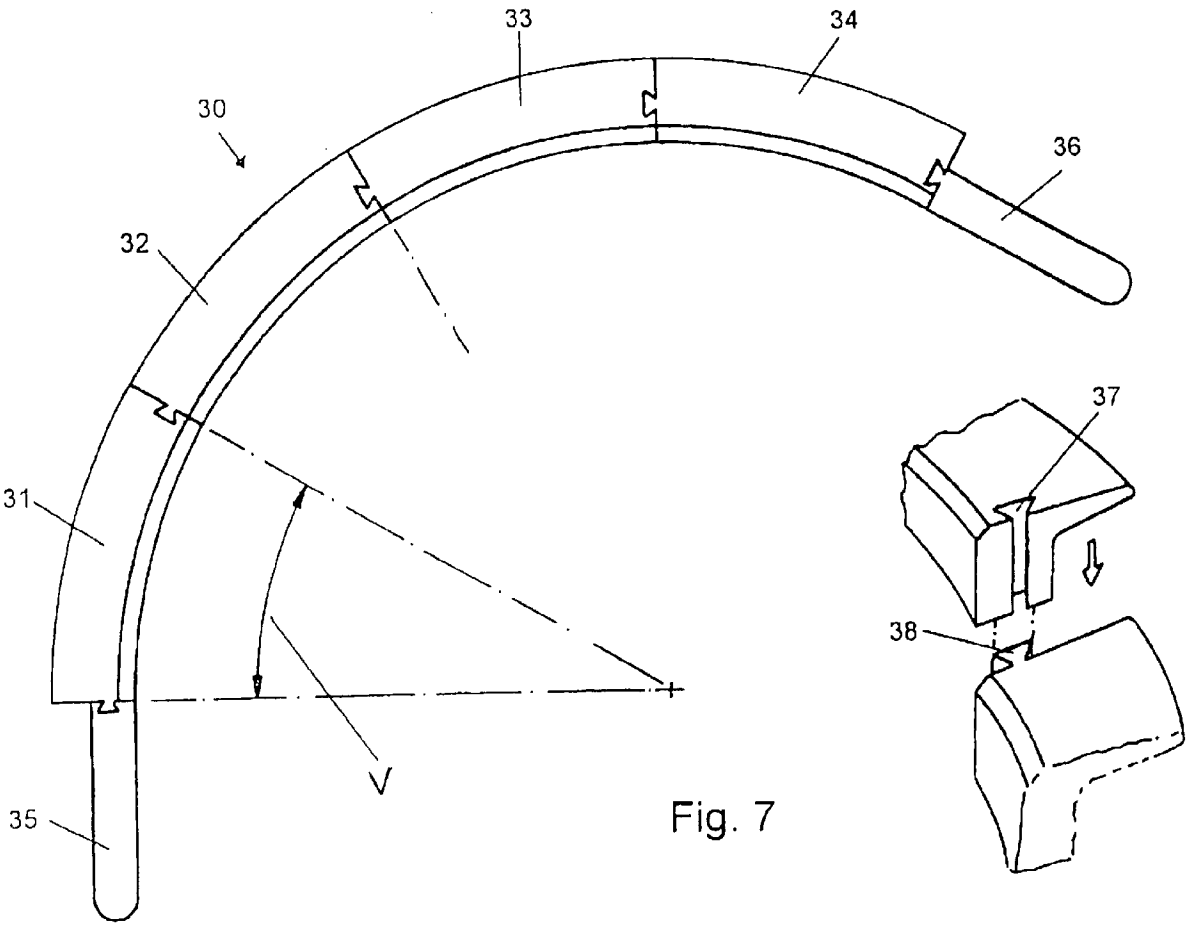

The invention will be explained more fully below with reference to the following description of some embodiments with reference to the drawing, in which FIG. 1 shows an explanatory sketch of the game according to the invention, FIG. 2 shows a self-propelled vehicle for use in connection with the game according to the invention, FIG. 3 shows a deflection element according to the invention, FIGS. 4–6 illustrate various functions of the vehicle of FIG. 2, while FIG. 7 shows details of the deflection element shown in FIG. 3.

FIG. 1 shows a pair of players, preferably children, who each have a deflection element 1 and 2 which they can hold in their hands and displace in all directions on a base, e.g. a floor. A self-propelled vehicle 3 runs on the base. The game thus comprises catching the vehicle 3 from the opponent with one's own deflection element and sending the vehicle back to the opponent. The vehicle may be sent off in various directions and is given different speeds when it leaves the deflection element as a consequence of the centrifugal force if the deflection element is simultaneously turned around. The versatility and play value of the game, as explained above in connection with FIG. 1, will be described more fully with reference to the following figures.

The vehicle 3 in FIG. 1 may be constructed like the vehicle shown in FIG. 2. The vehicle has an electric motor (not shown) with associated battery as well as an electrical reversing switch that may be affected as described more fully below. The front wheels 4, 5 of the vehicle are preferably made of hard and smooth plastics which gives low friction against the smooth concave and curved deflection track of the deflection elements. The rear wheels, of which the rear wheel 6 can be seen, are normally made of rubber owing to the propulsion force, and to prevent the rubber from providing a too great friction against the deflection elements, the embodiment shown includes a hub cap 7 of hard plastics which gives low friction against the deflection elements. The vehicle also has a gun 8 with a projectile 9 and a release mechanism 10 which, when affected mechanically, releases a lock mechanism in the gun so that the projectile 9 is fired, see FIG. 4.

The vehicle show in FIG. 2 moreover has a movable front portion 11 with coupling studs 12, 13. When the coupling studs are affected rearwards, the entire front portion 11 will be pushed rearwards, and also the arms 14 and 15 are pivoted rearwards. Hereby, an electrical switch (not shown) is affected so that the traveling direction of the vehicle is changed from forward to reverse. The various positions of the front portion 11 are achieved by means of expediently located pivot points relative to rubber bands, of which the rubber band 16 can be seen.

FIG. 4 shows an activation mechanism 17 which is secured to a deflection element 2, and which has an activation arm 18 that may be affected by a finger, so that the activation mechanism 17 extends inwards over the track of the vehicle and can strike the release mechanism 10. This causes the projectile 9 to be fired, as shown at 9*a* in FIG. 4. The player can try to hit the opponent with the projectile 9.

FIG. 5 shows an obstacle 20 and also shows a bumper 21 which is mounted on the coupling studs 12, 13 in FIG. 2. FIG. 5 moreover shows a driver 22 who is placed on the front portion 11 (FIG. 2).

When the bumper 21 hits the obstacle 20, the front portion 11 will be pushed backwards and upwards forwardly, whereby the upwardly extending forks of the bumper 21 catch the obstacle 20. When the front portion 11 pivots back, it will affect the electrical switch such that the traveling direction is changed from forward to reverse, whereby the vehicle carries along the obstacle 20 in the rearward movement.

FIG. 6 shows another possible variation, including a portal with a crossbar 26 that carries a plate 27. When an upwardly extending arm 28*o* hits the plate 27, the arm 28 will affect the electrical switch either directly or through the front portion 11, so that the vehicle switches from forward to reverse. In the embodiment shown in FIG. 6, the front portion of the vehicle has a slot for receiving a wheel or a roller 29, which is disposed freely inside the fork of the front portion. At the moment when the vehicle is reversed from forward to reverse, the wheel 29 will roll on and be sent out in a direction toward the opponent.

It will be appreciated that other activities than those described above may be introduced, and that the players themselves can choose what the game is to comprise. There may also be 3 or 4 players each having a deflection element of his own, and it is possible to play with two or more vehicles at the same time. As a further possible variation, the deflection elements may also be shaped differently.

FIG. 7 shows an embodiment of the deflection element 30 according to the invention. The deflection element comprises four curved sections 31–34, which are identical, and which are curved corresponding to the curve angle V. Moreover a pair of straight sections 35 and 36 are provided, As shown at 37 and 38, the individual sections may be pushed together, which means that the user himself may decide how the deflection element is to be configured. The straight sections 35 and 36 need not be of the same length, and precisely the form of deflection element desired by the user may be obtained hereby. Alternatively, the deflection element may be made of such an elastic material that the player can bend it in use.

What is claimed is:

1. A toy game comprising a self-propelled vehicle having a side and at least two deflection elements, each of said deflection elements being movable on a base whereon said vehicle travels, each of said deflection elements having a curved, concave track for approximately frictionless cooperation with said side of the vehicle, said track being substantially upstanding and lacking a component on which said vehicle can travel, each of said deflection elements further having an underside and a grip extending therefrom so that a player can reorient and move each of said deflection elements on the base while said vehicle is traveling thereon to catch said vehicle along said track and to change a direction of travel of said vehicle.

2. A game according to claim 1, characterized in that the side of the vehicle includes friction-reducing areas for cooperation with parts of the concave track of the deflection elements.

3. A game according to claim 2, wherein said friction-reducing areas and concave track parts comprise smooth plastic surfaces.

4. A game according to claim 1, characterized in that the vehicle has means which are adapted to change the direction of travel of the vehicle.

5. A game according to claim 4, characterized in that the means comprise a steering mechanism.

6. A game according to claim 4, characterized in that the vehicle includes propulsion means and further comprising means for reversing the propulsion means between forward and reverse.

7. A game according to claim 6, characterized in that the reversing means are dependant on a movable bumper.

8. A game according to claim 6, characterized in that the reversing means are dependent on a protruding antenna.

9. A game according to claim 1, characterized in that more than two deflection elements are provided.

10. A game according to claim 1, characterized in that the game comprises obstacles for mounting on the base.

11. A game according to claim 6, characterized in that the vehicle is adapted to release an object when changing direction of travel.

12. A game according to claim 1, characterized in that the vehicle has an ejection mechanism for ejecting an object when an activation arm on the vehicle is affected.

13. A game according to claim 1, characterized in that the deflection elements are flexible.

14. A game according to claim 1, characterized in that the deflection elements comprise a plurality of interconnected sections.

15. A game according to claim 14, characterized in that the sections comprise curved and straight parts.

* * * * *